United States Patent [19]

Straub

[11] Patent Number: 4,844,046

[45] Date of Patent: Jul. 4, 1989

[54] COMPRESSED AIR GUN WITH LEVER ATTENUATOR

[75] Inventor: Dieter Straub, Ulm/Donau, Fed. Rep. of Germany

[73] Assignee: J. G. Anschutz GmbH, Ulm/Donau, Fed. Rep. of Germany

[21] Appl. No.: 161,377

[22] Filed: Feb. 22, 1988

Related U.S. Application Data

[63] Continuation of Ser. No. 96,227, Sep. 8, 1987, abandoned, which is a continuation of Ser. No. 841,215, Mar. 19, 1986, abandoned.

[30] Foreign Application Priority Data

Mar. 20, 1985 [DE] Fed. Rep. of Germany ..... 3510087

[51] Int. Cl.[4] ..... F41B 11/00

[52] U.S. Cl. ..... 124/80; 124/69

[58] Field of Search ..... 124/61, 67, 68, 69, 124/70, 80; 172/260.5; 417/903; 92/143

[56] References Cited

U.S. PATENT DOCUMENTS

| | | | |
|---|---|---|---|
| 962,217 | 6/1910 | Heckman | 124/67 |
| 3,760,882 | 9/1973 | Geurts | 172/260.5 |
| 4,041,927 | 8/1977 | Van House | 124/61 |

FOREIGN PATENT DOCUMENTS

| | | | |
|---|---|---|---|
| 622475 | 11/1935 | Fed. Rep. of Germany | 124/67 |
| 1264295 | 3/1968 | Fed. Rep. of Germany . | |
| 2631256 | 1/1978 | Fed. Rep. of Germany . | |

*Primary Examiner*—Richard T. Stouffer

*Attorney, Agent, or Firm*—Collard, Roe & Galgano

[57] ABSTRACT

An improved operating mechanism for an air gun is disclosed which features an attenuation element interposed between the operating level and the other elements of the gun. The attenuation element may comprise a single acting gas spring, such that the operating lever is prevented from violent motion returning it to the open position upon release during the closing movement from the open to the closed position, but in which movement of the lever from the open to the closed position is not impeded by the attenuation element.

10 Claims, 1 Drawing Sheet

COMPRESSED AIR GUN WITH LEVER ATTENUATOR

This application is a continuation of application Ser. No. 07/096,227, filed Sept. 8, 1987, now abandoned, which is a continuation of application Ser. No. 06/841,215, filed Mar. 19, 1986, now abandoned.

FIELD OF THE INVENTION

This invention relates to an improved operating mechanism for compressed air guns, including both pistols and rifles. More particularly, the invention relates to an improved operating mechanism in which the operating lever is prevented from springing back violently toward the face of the marksman, which is a common defect of prior designs.

BACKGROUND OF THE INVENTION

A common construction of compressed air guns, including both pistols and rifles, involves an operating lever which is moved from an open to a closed position by the marksman prior to firing. In so doing, the marksman compresses a quantity of air which subsequently is used to propel the projectile. Typically, the operating lever is pivoted with respect to the weapon, such that in the open position it is disposed laterally away from the gun with its free end, and in the closed or locked position it rests against the gun, generally parallel to the barrel of the weapon. During movement of the lever from the open position to the locked position it moves the part which compresses the air. Thus, to prepare to fire the marksman moves the pivoted operating lever from its open position towards him to the closed position.

Motion of the operating lever from the closed to the open position is opposed only by small suction forces, such that the lever moves freely. On the other hand, in order to close the lever, the marksman must exert substantial force on the handle of the lever in order to compress the gas later used to propel the projectile.

A difficulty which is engendered by this design is that should the marksman release the lever before the lever has reached its closed position in which it is retained by a catch, an overcenter linkage or similar mechanism, the lever rapidly pivots, essentially unimpeded, due to the substantial force exerted by the compressed gas. Thus the lever can move to its open position rather violently and since its free end is pointed laterally towards the rear of the weapon the lever may strike the marksman and cause him injury. This is especially true when the marksman operates the lever of the weapon to compress air when the marksman is in the prone firing position, in which typically the operating lever is disposed very close to the marksman's face.

SUMMARY OF THE INVENTION

It is therefore an object of the invention to provide an improved operating mechanism for a compressed air gun in which violent movement of the operating lever towards the marksman in the event he releases the lever during the closing operation is prevented.

It is a further object of the invention to provide an improved compressed air gun, in which the operating lever is prevented from moving violently towards the marksman if he should release the lever during movement between the open and closed positions, yet in which the ordinary operation of the gun is not impeded.

The above needs of the art and objects of the invention are met by the present invention which comprises an improved operating mechanism for a compressed air gun. A single-acting attenuation element, that is, one which resists motion in one direction but not in another, is interposed between the operating lever and the weapon. The arrangement of the attenuation element is such that the motion of the operating lever is attenuated only in movement from its closed position into the open position. Should the operating lever be released during the closing operation it is restrained from flying violently toward the marksman situated near the back end of the gun. However, the effort required to cause the weapon to compress air is not increased because the attenuation element is single-acting.

The attenuation element can be mechanical, hydraulic, or pneumatic, or mixtures of these. In a particularly preferred embodiment of the invention, a conventional gas spring, that is, a telescopic pneumatic attenuator, is used. Such gas springs can be made quite small and lightweight but are very effective in this particular application. Gas springs are known which are single-acting, that is, which resist motion in only one direction.

In the preferred embodiment of the invention, the gas spring attenuation element is arranged to lie parallel to the locking lever and the barrel of the weapon in the closed position, and to remain substantially parallel to the barrel in the open position, so as to avoid unduly to the overall bulk of the weapon.

BRIEF DESCRIPTION OF THE DRAWINGS

The invention will be better understood if reference is made to the accompanying drawings, in which.

DESCRIPTION OF THE PREFERRED EMBODIMENTS

Figure 2:
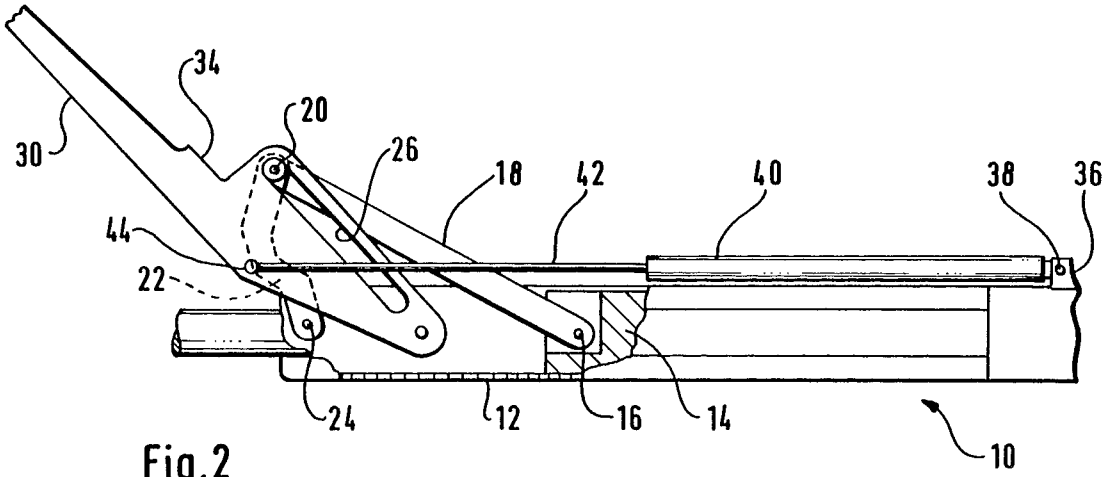
FIG. 2 shows a similar view of the weapon according to the invention in the open position.
Figure 1:
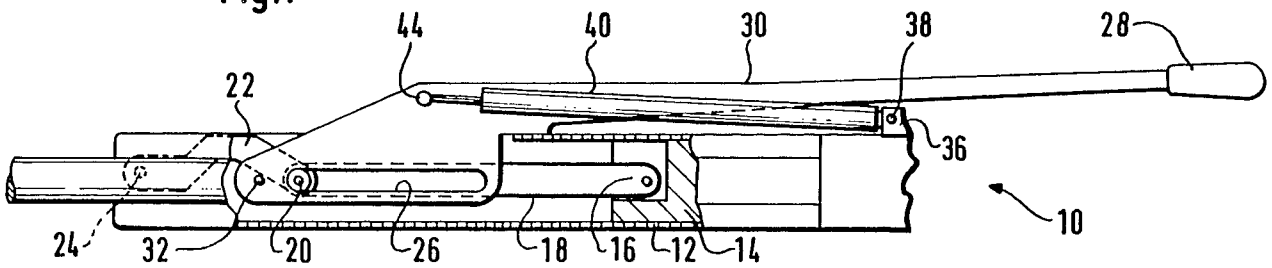
FIG. 1 shows a partially cutaway top view of a compressed air gun including the improved operating mechanism of the invention, in the closed position.

FIGS. 1 and 2 shows a compressed air gun having an improved operating mechanism according to the invention. The gun 10 comprises a cylinder 12, in which a piston 14 slides for compressing air used to propel a projectile. The piston is moved from the position shown in FIG. 2 to the position shown in FIG. 1 when a marksman moves operating lever 30, which terminates in a handle 28, from the open to the closed position. The lever 30 is connected to the piston 14 by a connecting rod 18. Connecting rod 18 is pivoted at a pivot 16 to the piston 14, and to a bushing 20 sliding within a slot 26 in the lever 30. The lever 30 is fixed to the weapon 10 at a pivot point 32, about which the lever 30 swings between a closed position adjacent the gun and an open position disposed laterally away from the gun.

In order to provide a mechanical advantage to the marksman, for easing operation, an offset lever 22 is pivoted coaxially with the bushing 20 and together with connecting rod 18 forms a bell crank. The other end of offset lever 22 is pivotally fixed to the gun at 24. This construction is generally understood in the prior art to provide a mechanical advantage to the marksman, thus enabling increased compression of gas for exertion of a given muscular effort.

The extent of the forward motion of lever 30 is defined by the point at which the bushing 20 reaches the end of the slot 26, as shown in FIG. 2. The rearward motion of lever 30 is limited by the abutting of a shoulder 34 formed thereon against the barrel of the weapon 10. Preferably the shoulder 34 is shaped so as to prevent the handle 28 from contacting the mechanism of the gun.

As mentioned above, there is little force restraining the motion of the lever 30 in traverse between the closed position of FIG. 1 and the open position of FIG. 2. The force required to compress the gas is substantial, and opposes its motion in the reverse direction, i.e., between the open position and the closed position. Therefore, should the marksman release the lever during the closing operation, and particularly towards the latter stages thereof, the lever is permitted to fly back toward the open position with great force and at relatively high velocity. Should the lever then strike the marksman, which is quite possible particularly when shooting from the prone position, the marksman can be seriously injured. Therefore, the present invention provides a means for restraining this motion, which does not interfere with the operation of the gun.

This improvement is provided according to the present invention in which an attenuation element 40 is interposed between the mechanism of the weapon 10 and the lever 30. In the preferred embodiment shown, a telescoping gas spring 40 is interposed between a pivot point 44 on the lever and another pivot point 38 formed by an upstanding lug 36 on the barrel of the gun 10. The gas spring is preferably a conventional gas spring, such as a telescopic pneumatic attenuator. It may be, however, another type of mechanical attenuator such as a hydraulic attenuation element. Preferably the gas spring is also single-acting; that is, it resists extension but does not resist compression. In this way the motion of the lever 30 from the closed to the open position is attenuated by the member 40, but the effort required of the marksman in the return direction is not increased by the addition of the gas spring. Thus the danger of injury to the marksman is substantially reduced by the addition of the attenuating gas spring, which prevents violent opening motion of the operating lever, without substantially adding to the force required of the marksman to prepare the weapon for firing. In this way danger to the marksman is substantially eliminated without impeding the function of the gun in any way. In effect, the energy stored by compression of the gas upon closing lever 30 of the gun is dissipated by the attenuating member, rather than in violent motion of the lever. This substantially reduces the danger of injury to the marksman.

As can be observed from the drawings, an angle of approximately 30 degrees is formed between a line connecting the pivot points 44 and 32 and the axis of elongation of the slot 26. As can also be observed, the distance from the hinge point 44 at which the piston rod 42 of the gas spring is pivoted to the lever 30 to the pivot point 32 is approximately equal to the distance through which the bushing 20 moves along the slot 26.

While a preferred embodiment of the invention has been shown and described, this should not be taken as a limitation on the scope of the invention but as merely exemplary thereof. The scope of the invention is to be limited only by the following claims.

I claim:

1. A compressed air gun, comprising:

a cylinder;

a piston movable in said cylinder to compress the gas therein;

a connecting rod connected to said piston;

an operating lever connected to said connecting rod and pivoted with respect to said air gun, said lever being movable in both directions between a closed position and an open position, said lever causing said movable piston to compress the gas in said cylinder as said lever moves from said open position to said closed position; and means for attenuating the motion of said lever during the movement thereof to said open position under the influence of said gas, when compressed said attenuating means being single-acting and attenuating the motion of said lever only as said lever moves from said closed position to said open position, but not opposing movement of said lever as said lever moves from said open position to said closed position.

2. The compressed air gun as defined in claim 1, wherein said attenuating means comprises a mechanical attenuation element.

3. The compressed air gun as defined in claim 1, wherein said attenuating means comprises a hydraulic attenuation element.

4. The compressed air gun as defined in claim 1, wherein said attenuating means comprises a pneumatic attenuation element.

5. The compressed air gun as defined in claim 1, wherein said attenuating means comprises a gas spring.

6. The compressed air gun as defined in claim 5, wherein said gas spring is substantially parallel to said gun when said operating lever is in the closed position.

7. The compressed air gun as defined in claim 1, wherein said operating lever is connected to said connecting rod by means providing a mechanical advantage therebetween.

8. The compressed air gun as defined in claim 7, wherein said connecting means includes a bell crank.

9. The compressed air gun as defined in claim 1, wherein said attenuating means is pivotally mounted at one end to said compressed air gun.

10. The compressed air gun as defined in claim 1, wherein the air gun includes a forward end and a back end, in said closed position said operating lever extending adjacent said gun towards the back end thereof, and in said open position extending laterally and generally toward the forward end of said gun.

* * * * *